US011383530B2

(12) United States Patent
Ochi et al.

(10) Patent No.: US 11,383,530 B2
(45) Date of Patent: Jul. 12, 2022

(54) INKJET PRINTING APPARATUS, PROGRAM, AND RECORDING MEDIUM

(71) Applicant: MIMAKI ENGINEERING CO., LTD., Nagano (JP)

(72) Inventors: Kazuhiro Ochi, Nagano (JP); Akira Takeuchi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 17/087,599

(22) Filed: Nov. 2, 2020

(65) Prior Publication Data

US 2021/0046770 A1 Feb. 18, 2021

Related U.S. Application Data

(63) Continuation of application No. 15/115,268, filed as application No. PCT/JP2015/052241 on Jan. 27, 2015, now abandoned.

(30) Foreign Application Priority Data

Jan. 31, 2014 (JP) ..... 2014-017913

(51) Int. Cl.
*B41J 11/00* (2006.01)

(52) U.S. Cl.
CPC .... *B41J 11/00212* (2021.01); *B41J 11/00214* (2021.01); *B41J 11/00218* (2021.01)

(58) Field of Classification Search
None
See application file for complete search history.

(56) References Cited

U.S. PATENT DOCUMENTS

2012/0256997 A1* 10/2012 Usuda ..... B41J 2/45 347/233

* cited by examiner

*Primary Examiner* — Alejandro Valencia
(74) *Attorney, Agent, or Firm* — JCIPRNET

(57) ABSTRACT

An object is to suppress variation in dot diameter. As a solution, an irradiation control unit (50) performs control for selecting an irradiating element (E2) having a distance from a nozzle (n) to eject irradiation target ink, smaller than that of an irradiating element (E3) which has the maximum distance difference with respect to the distance between the nozzle (n) and an irradiating element (E1) selected as an irradiating element for ink ejected from the nozzle (n) on an outward way, as an irradiating element which is selected on a homeward way.

5 Claims, 3 Drawing Sheets

INKJET PRINTING APPARATUS, PROGRAM, AND RECORDING MEDIUM

CROSS-REFERENCE TO RELATED APPLICATION

This application is a continuation application of U.S. application Ser. No. 15/115,268, filed on Jul. 29, 2016. The prior application Ser. No. 15/115,268 is a 371 of international application of PCT application serial no. PCT/JP2015/052241, filed on Jan. 27, 2015, which claims the priority benefits of Japan application no. JP 2014-017913, filed on Jan. 31, 2014. The entirety of each of the above-mentioned patent applications is hereby incorporated by reference herein and made a part of this specification.

TECHNICAL FIELD

The present invention relates to an inkjet printing apparatus, a program, and a recording medium.

BACKGROUND ART

PTL 1 discloses an inkjet printer, which has inkjet nozzles configured to output ultraviolet curing ink, and a pair of ultraviolet LEDs provided on both sides in the movement direction of the inkjet nozzles and configured to radiate ultraviolet light for hardening ultraviolet curing ink.

CITATION LIST

Patent Literature

PTL 1: JP-A-2005-144679

SUMMARY

Technical Problem

According to the inkjet printer disclosed in PLT 1, on the outward way of the inkjet nozzles, it is possible to eject ink and radiate ultraviolet light, and even on the homeward way, it is possible to eject ink and radiate ultraviolet light.

However, if a time on the outward way from when ink ejected from a certain nozzle lands on a recording medium to when the ink is irradiated with ultraviolet light is different from a time on the homeward way from when ink ejected from the corresponding nozzle lands on the recording medium to when the ink is irradiated with ultraviolet light, even though ink has been ejected from the same nozzle, the diameters of dots which are formed by that ink are different, resulting in a problem that the image quality deteriorates.

The present invention was made in view of this problem, and an object of the present invention is to suppress variation in dot diameter.

Solution to Problem

In order to achieve the above described object, an inkjet printing apparatus according to the present invention includes: a head configured to eject ink which hardens if being subjected to irradiation with light, onto a recording medium; irradiating means configured to irradiate the ink ejected from the head, with light; and an irradiation control means configured to control light irradiation of the irradiating means, wherein the head is configured to relatively reciprocate with respect to a mounting table for mounting the recording medium, and the plurality of irradiating means is disposed, such that they are aligned in the relative reciprocation direction and the head is disposed between two irradiating means, and is configured to relatively reciprocate in the same direction as the relative reciprocation direction with respect to the recording medium, together with the head, and on each of the plurality of irradiating means, a plurality of irradiating elements is mounted, such that at least two irradiating elements of the plurality of irradiating elements are disposed at positions different from each other in the distance in the relative reciprocation direction from at least one nozzle of the nozzles of the head, and the irradiation control means is configured to perform control for selecting an irradiating element having a distance from a certain nozzle, smaller than that of an irradiating element which has the maximum distance difference with respect to the distance between the certain nozzle and an irradiating element selected as an irradiating element for ink ejected from the certain nozzle on the outward way, on the homeward way.

According to the above described configuration, it is possible to reduce the time difference between a time on the outward way from when ink ejected from a certain nozzle lands on the recording medium to when the ink is irradiated with ultraviolet light, and a time on the homeward way from when ink ejected from the certain nozzle lands on the recording medium to when the ink is irradiated with ultraviolet light. Therefore, it is possible to suppress variation in dot diameter.

In the inkjet printing apparatus according to the present invention, the irradiation control means may be configured to divide the plurality of irradiating elements into a plurality of irradiation areas and control the irradiation elements, and the irradiation control means may be configured to perform control for selecting an irradiation area having a distance from a certain nozzle to eject irradiation target ink, smaller than that of an irradiation area which has the maximum distance difference with respect to the distance between the certain nozzle and an irradiation area selected as an irradiation area for ink ejected from the certain nozzle on the outward way, as an irradiation area which is selected on the homeward way.

Since it is possible to collectively control a large number of irradiating elements, it is possible to change the intensity and timing of irradiation on each area while facilitating scanning and processing, and fine control on image quality becomes possible.

In the inkjet printing apparatus according to the present invention, the irradiation control means may be configured to perform control for selecting an irradiating element having a distance from a certain nozzle to eject irradiation target ink which has the minimum distance difference with respect to the distance between the certain nozzle and an irradiating element selected as an irradiating element for ink ejected from the certain nozzle on the outward way, as an irradiating element which is selected on the homeward way.

According to the above described configuration, it is possible to further reduce the time difference between a time on the outward way from when ink ejected from a certain nozzle lands on the recording medium to when the ink is irradiated with ultraviolet light and a time on the homeward way from when ink ejected from the certain nozzle lands on the recording medium to when ink is irradiated with ultraviolet light. Therefore, it is possible to further suppress variation in dot diameter.

The inkjet printing apparatus according to each aspect of the present invention may be implemented by a computer. In this case, a program for making the computer operate as the irradiation control means of the inkjet printing apparatus, thereby implementing the inkjet printing apparatus in the computer, and a computer-readable recording medium recording the corresponding program also fall within the scope of the present invention.

Advantageous Effects of Invention

According to the present invention, an effect that it is possible to suppress variation in dot diameter is achieved.

DESCRIPTION OF EMBODIMENTS

First Embodiment

Figure 1:
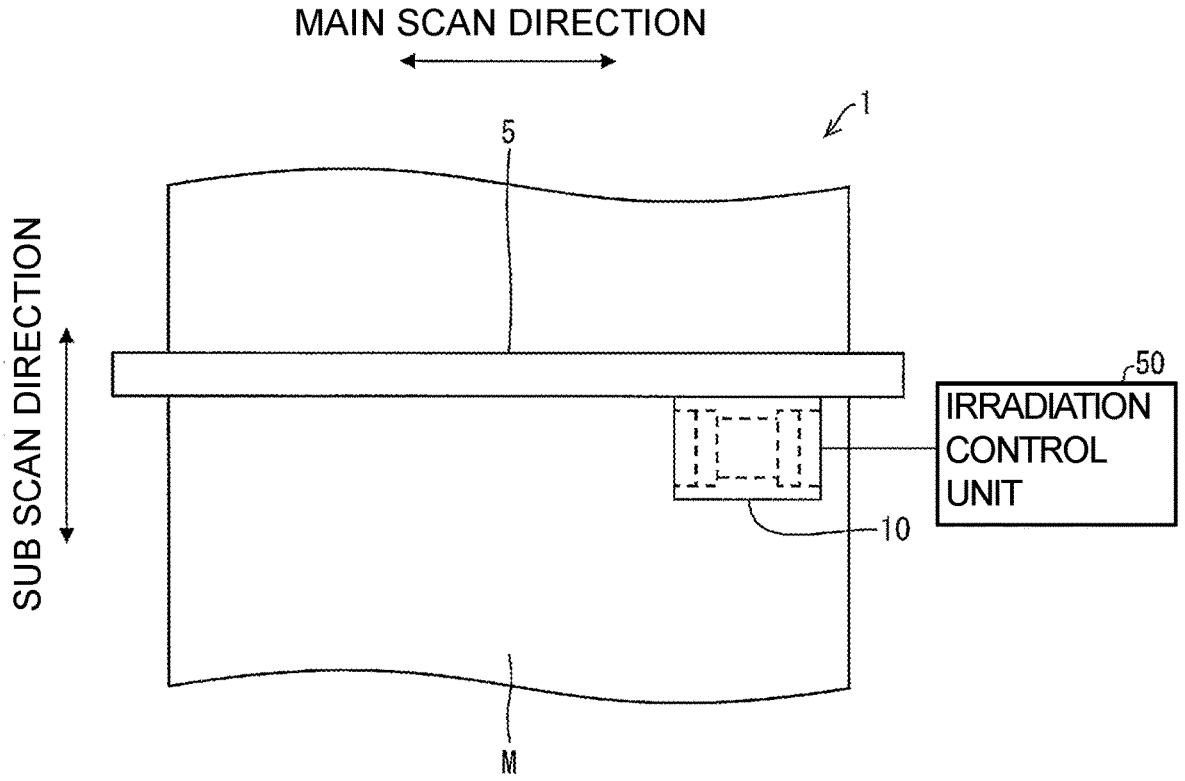
FIG. 1 is an explanatory view of an inkjet printing apparatus 1 according to an embodiment of the present invention.
Figure 2:
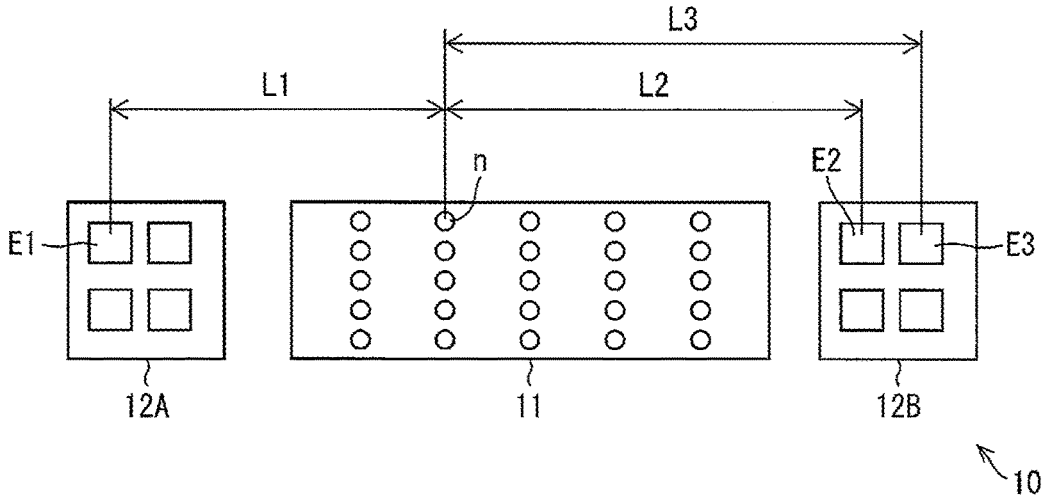
FIG. 2 is a view schematically illustrating the structure of a carriage 10 which is included in the inkjet printing apparatus 1.

An inkjet printing apparatus 1 which is an embodiment of an inkjet printing apparatus according to the present invention will be described with reference to FIGS. 1 and 2. FIG. 1 is a schematic diagram of the inkjet printing apparatus 1. FIG. 2 is a view schematically illustrating the structure of a carriage 10 which is included in the inkjet printing apparatus 1.

The inkjet printing apparatus 1 includes a Y bar 5, the carriage 10, and an irradiation control unit (an irradiation control means) 50. Also, the inkjet printing apparatus 1 is configured to perform printing on a medium (a recording medium) M, and FIG. 1 shows the medium M mounted on a mounting table (not shown).

[Y Bar 5]

The Y bar 5 extends in one direction. The direction in which the Y bar 5 extends is a main scan direction of the inkjet printing apparatus 1. In other words, the main scan direction is a direction parallel to the direction of the mounting table in a plane.

Also, a direction which is perpendicular to the main scan direction and is parallel to the direction of the mounting table in a plane is a sub scan direction. The medium M is conveyed in the sub scan direction.

[Carriage 10]

The carriage 10 is attached to the Y bar 5, and reciprocates in the main scan direction. Therefore, the carriage 10 relatively moves with respect to the mounting table. As a result, a head 11 (to be described below) relatively moves with respect to the mounting table.

In the present embodiment, a configuration in which the head 11 moves in the main scan direction but the medium M does not move in the main scan direction will be described. However, the present invention is not limited thereto, and may have a configuration in which the head is fixed and a recording medium reciprocates in the main scan direction.

The carriage 10 includes the head 11, an irradiating unit (an irradiating means) 12A, and an irradiating unit 12B.

[Head 11]

The head 11 is for ejecting ink which hardens if being subjected to irradiation with light, onto the medium M.

Specifically, the head 11 has nozzles n formed therein, and ink is ejected from the nozzles n.

Ink needs only to be hardened by light radiated by an irradiating means, and for example, it is preferable to use ultraviolet light as light for irradiation, and use ultraviolet curing ink as ink. In the present embodiment, a configuration in which the head 11 is configured to eject ultraviolet curing ink will be described.

[Irradiating Unit 12A and Irradiating Unit 12B]

The irradiating units 12A and 12B are for radiating ultraviolet light onto ink ejected from the head 11. Ink ejected from head 11 is hardened by ultraviolet light radiated from the irradiating units 12A and 12B.

Also, the irradiating units 12A and 12B are disposed, such that they are aligned in the main scan direction and the head 11 is disposed between the irradiating unit 12A and the irradiating unit 12B. Therefore, the irradiating units 12A and 12B move in the same direction as the movement direction of the head 11, that is, in the main scan direction.

Each of the irradiating units 12A and 12B has a plurality of irradiating elements.

At least two irradiating elements of the plurality of irradiating elements are disposed at positions different from each other in the distance in the main scan direction from at least one nozzle of the head 11.

For example, as shown in FIG. 2, the distances of an irradiating element E2 and an irradiating element E3 from a nozzle n in the main scan direction are L2 and L3, respectively, and these distances are different from each other.

[Irradiation Control Unit 50]

The irradiation control unit 50 is for controlling light radiation of the irradiating units 12A and 12B.

For example, the irradiation control unit 50 performs control for selecting an irradiating element to radiate ultraviolet light onto ink ejected from a certain nozzle and landed on the medium M, from the irradiating elements mounted on the irradiating units 12A and 12B.

As the selecting method, the irradiation control unit selects an irradiating element having a distance from the certain nozzle to eject target ink, smaller than that of an irradiating element which has the maximum distance difference with respect to the distance between the certain nozzle and an irradiating element selected as an irradiating element for ink ejected from the certain nozzle on the outward way. Therefore, it is possible to reduce the time difference between a time on the outward way from when ink ejected from a certain nozzle lands on the recording medium to when the ink is irradiated with ultraviolet light, and a time on the homeward way from when ink ejected from the certain nozzle lands on the recording medium to when the ink is irradiated with ultraviolet light. Therefore, it is possible to suppress variation in dot diameter.

Also, in this specification, as for the outward way and the homeward way, movement in one direction in reciprocating movement is referred to as the "outward way", and the return way thereof is referred to as the "homeward way". The outward way is not limited to movement of the head or the like from its initial position. For example, the head may temporarily move from the initial position to the other end. In this case, with reference to the position after the movement, movement to the initial position is referred to as the "outward way", and movement to the other end is referred to as the "homeward way".

For example, in a case of selecting an irradiating element E1 on the outward way with respect to ink ejected from the nozzle n and landed on the medium M, on the homeward way, with respect to ink ejected from the nozzle n and landed on the medium M, the irradiation control unit 50 selects the irradiating element E2, not the irradiating element E3. The reason is as follows.

In other words, in the irradiating elements of the irradiating unit 12B, irradiating elements capable of radiating ultraviolet light for hardening ink ejected from the nozzle n and landed on the medium M on the homeward way are the irradiating element E2 and the irradiating element E3 aligned with the nozzle n in the main scan direction and to pass immediately above the corresponding ink. In them, the distance difference between the distance L3 from the irradiating element E3 to the nozzle n and the distance L1 from the irradiating element E1 to the nozzle n is larger than the distance difference between the distance L2 from the irradiating element E2 to the nozzle n and the distance L1 from the irradiating element E1 to the nozzle n. In the present embodiment, the irradiating element E3 is an irradiating element having the maximum distance difference with respect to the distance L1, among the irradiating elements related to the ink ejected from the nozzle n.

If the irradiating element E2 is selected, the distance L2 from the nozzle n has the small distance difference related to the distance L1 between the irradiating element and the nozzle n, as compared to the distance L3. Therefore, the irradiation control unit 50 selects the irradiating element E2.

Also, in the present embodiment, if the irradiating element E2 is selected, from among the irradiating elements, the distance L2 has the minimum distance difference related to the distance L1.

In this way, it is possible to reduce the time difference between the outward way and the homeward way, in the time from when ink ejected from a same nozzle lands to when the ink is irradiated with ultraviolet light, and it is possible to reduce variation in dot diameter. If this control is performed on every nozzle, it is possible to substantially uniformize the diameters of all dots on the medium M, and thus it is possible to improve the image quality.

Also, as for selection of an irradiating element on the outward way, an irradiating element may be freely selected on the basis of the type of ink, the degree of a desired effect, and so on, and the irradiation control unit 50 selects an irradiating element from irradiating elements capable of radiating ultraviolet light onto ejected ink, on the basis of each condition input by a user.

Also, in some control modes, control may be performed such that not only the irradiating element E2 but also neighboring irradiating elements radiate ultraviolet light. In other words, in the present invention, it is necessary only to select at least one irradiating element having a distance from a certain nozzle, smaller that of an irradiating element which has the maximum distance difference with respect to the distance between the certain nozzle and an irradiating element selected as an irradiating element for ink ejected from the certain nozzle on the outward way. Therefore, irradiation with ultraviolet light on the homeward way starts at a time closer to the time on the outward way from ejection of ink from a nozzle to start of irradiation with ultraviolet light, and thus it is possible suppress variation in dot diameter.

By the above described operation, the irradiation control unit 50 selects irradiating elements to be used on the outward way and the homeward way.

Second Embodiment

Figure 3:
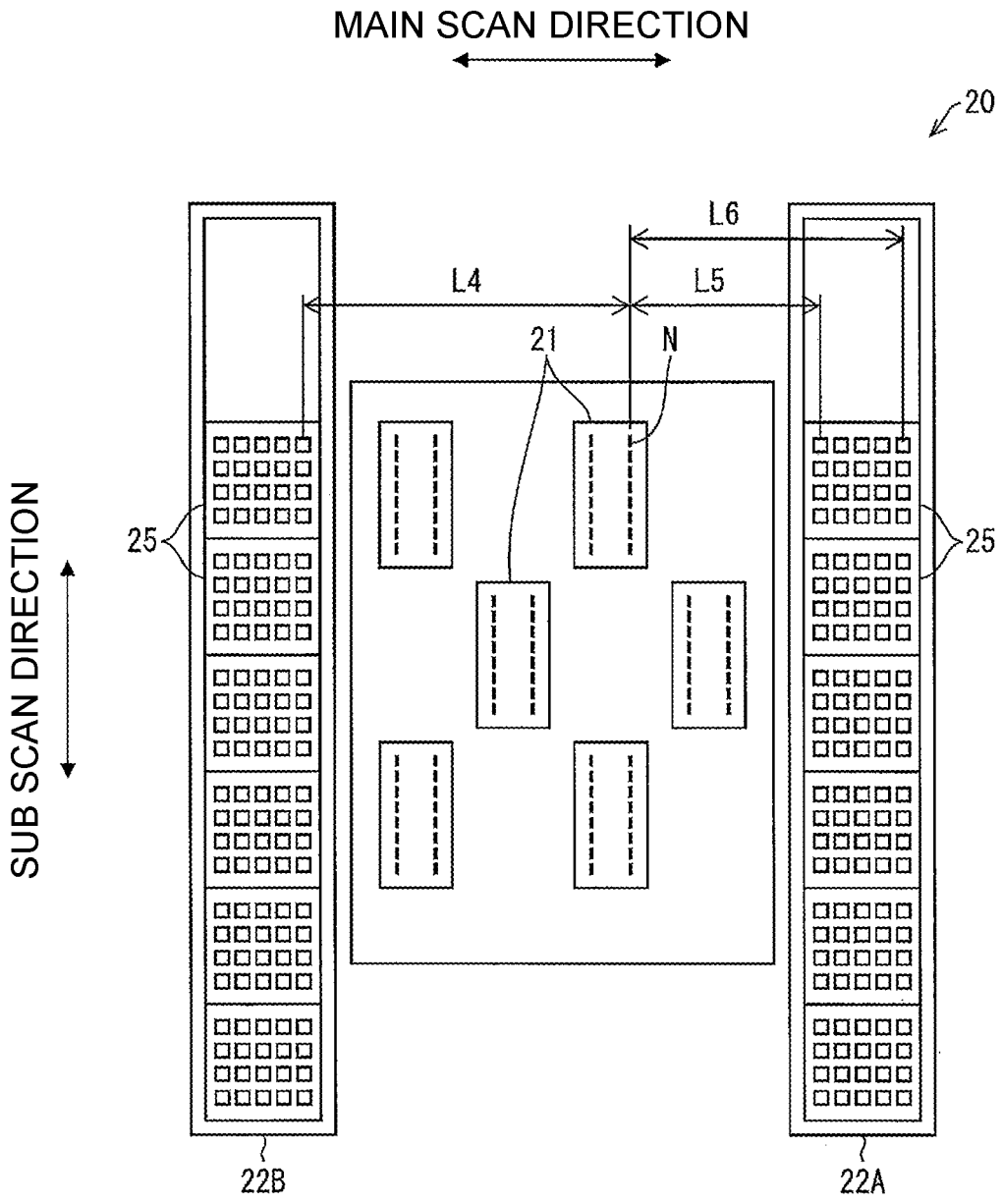
FIG. 3 is a schematic diagram illustrating the configuration of a carriage 20 which is included in an inkjet printing apparatus according to another embodiment.
Figure 4:
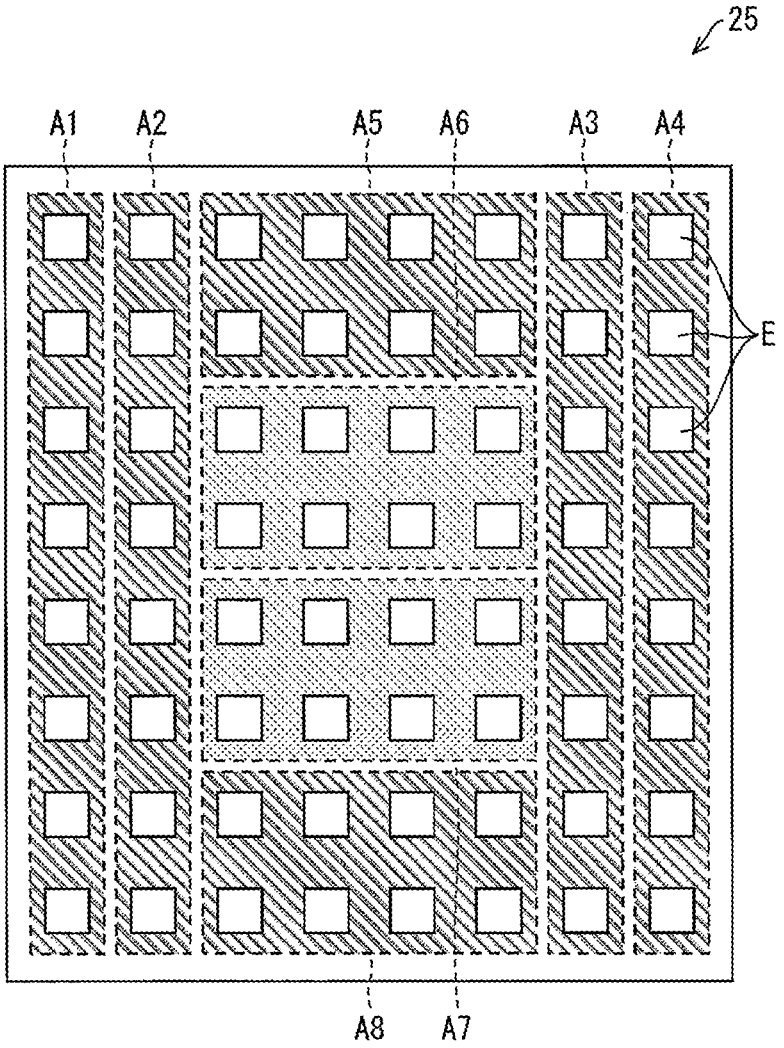
FIG. 4 is a schematic diagram illustrating the configuration of an irradiating unit 25 which is included in the carriage 20.

Another embodiment of the present invention will be described with reference to FIGS. 3 and 4. FIG. 3 is a schematic diagram illustrating the configuration of a carriage 20 of an inkjet printing apparatus according to a second embodiment. FIG. 4 is a schematic diagram illustrating the configuration of an irradiating unit 25 which is included in the carriage 20. Also, the present embodiment will be described on the assumption that it has the same configuration as that of the first embodiment except for the configuration of the carriage 20 and the control method of the irradiation control unit 50 to be described below.

The carriage 20 includes six heads 21, an irradiating unit 22A, and an irradiating unit 22B.

The six heads 21 are staggered. Each head has nozzle rows aligned having nozzles aligned in the sub scan direction.

Each of the irradiating units 22A and 22B has a plurality of irradiating units 25 aligned in the sub scan direction.

As shown in FIG. 4, each irradiating unit 25 has a number of irradiating elements E mounted thereon. Also, the plurality of irradiating elements E mounted on the irradiating units 25 are divided into a plurality of irradiation areas, and are controlled by the irradiation control unit 50.

Specifically, the irradiating elements E on each irradiating units 25 are divided into irradiation areas A1, A2, A3, A4, A5, A6, A7, and A8.

The irradiation areas A1, A2, A3, and A4 are formed by irradiating elements E aligned in the sub scan direction from one end to the other end in the corresponding direction, and are disposed on both sides of the irradiation areas A5, A6, A7, and A8. The irradiation areas A5, A6, A7, and A8 are obtained by dividing an area interposed between the irradiation areas A2 and A3 by a boundary line parallel to the main scan direction.

Now, with respect to control of the irradiation control unit 50 according to the present embodiment, control on the irradiating elements to be used for irradiation on ink ejected from a nozzle row N of the head 21 will be described as an example.

First, with respect to ink ejected from the nozzle row N and landed on the medium M on the outward way, the irradiation control unit 50 selects the irradiation area A4 of the irradiating unit 25 to pass immediately above the ink, from the irradiating unit 22B. The irradiation area A4 is selected on the basis of the type of ink, the degree of a desired effect, and the like.

If the irradiation area A1 of the irradiating unit 25 of the irradiating unit 22A is selected on the homeward way, the distance difference between the distance L4 between the nozzle row N and the irradiation area A4 selected on the outward way and the distance L5 between the nozzle row N and the irradiation area A1 of the irradiating unit 22A becomes the maximum as compared to the distance differences in cases of selecting the other irradiation areas. In other words, since the innermost irradiation area A4 has been selected on the outward way, if the innermost irradiation area A1 is selected on the homeward way, a large time difference in the time when irradiation of ink ejected from the nozzle row N with ultraviolet light starts is generated, and variation in dot diameter occurs.

In this case, if the irradiation area A4 of the irradiating unit 25 of the irradiating unit 22A is selected on the homeward way, the distance between the nozzle row N and the corresponding irradiation area A4 is L6. The distance difference between the distance L6 and the distance L4 is smaller than the distance difference between the distance L5 and the distance L4. Also, this distance difference is the smallest even as compared to cases of the other irradiation areas.

Therefore, the irradiation control unit 50 selects the irradiation area A4 of the irradiating unit 22A, as an irradiation area for hardening ink ejected from the nozzle row N, on the homeward way.

Like this, the control of the irradiation control means of the inkjet apparatus according to the present invention can be applied to various ultraviolet light irradiation means.

[Implementation Example Using Software]

The irradiation control unit 50 of the inkjet printing apparatus 1 may be implemented by a logic circuit (hardware) formed on an integrated circuit (an IC chip) and so on, or may be implemented by software which is executed by a CPU (Central Processing Unit).

In the latter case, the inkjet printing apparatus 1 includes a CPU configured to execute commands of a program which is software for implementing its individual functions, a ROM (Read Only Memory) or a storage unit (referred to as the "recording medium") in which the above described program and a variety of data have been recorded so as to be readable in a computer (or a CPU), a RAM (Random Access Memory) for developing the program, and so on. In this case, the computer (or the CPU) reads the program from the recording medium and executes the program, whereby the object of the present invention is achieved. As the above described recording medium, a "non-transitory tangible medium", such as a tape, a disk, a card, a semiconductor memory, or a programmable logic circuit, can be used. Also, the program may be supplied to the computer via an arbitrary transmission medium (such as a communication network or a broadcast wave) capable of transmitting the program. Also, the present invention can be implemented in the form of a data signal embedded as an embodiment of the program based on electronic transmission in a carrier wave.

The present invention is not limited to the above described embodiments, and can be variously modified within the scope defined by claims, and embodiments which can be obtained by appropriately combining the individual technical means disclosed in the different embodiments are also included in the technical scope of the present invention.

[ Supplementary Information]

As described above, the inkjet printing apparatus 1 includes the head 11 for ejecting ink onto the medium M, the irradiating units 12A and 12B for radiating light onto the ink ejected from the head 11, and the irradiation control unit 50 for controlling light irradiation of the irradiating units 12A and 12B. The head 11 is configured to relatively reciprocate with respect to the mounting table for mounting the medium M, and the plurality of irradiating units 12A and 12B are disposed, such that they are aligned in the relative reciprocation direction and the head 11 is disposed between the two irradiating units 12A and 12B, and is configured to relatively reciprocate in the same direction as the relative reciprocation direction with respect to the medium M, together with the head 11. On each of the irradiating units 12A and 12B, a plurality of irradiating elements is mounted, such that at least two irradiating elements of the plurality of irradiating elements are disposed at positions different from each other in the distance in the relative reciprocation direction from at least one nozzle n of the nozzles of the head 11. The irradiation control unit 50 is configured to perform control for selecting the irradiating element E2 having a distance from the nozzle n to eject irradiation target ink, smaller than that of the irradiating element E3 which has the maximum distance difference with respect to the distance between the nozzle n and the irradiating element E1 selected as an irradiating element for ink ejected from the nozzle n on the outward way, as an irradiating element which is selected on the homeward way.

According to the above described configuration, it is possible to reduce the time difference between the time on the outward way from when ink ejected from the nozzle n lands on the medium M to when the ink is irradiated with ultraviolet light and the time on the homeward way from when ink ejected from the nozzle n lands on the medium M to when the ink is irradiated with ultraviolet light. Therefore, it is possible to suppress variation in dot diameter.

In the other embodiment of the inkjet apparatus, the irradiation control unit 50 is configured to divide the plurality of irradiating elements into a plurality of irradiation areas and control the irradiation elements, and perform control for selecting the irradiation area A4 having a distance from a certain nozzle row N to eject irradiation target ink, smaller than that of the irradiation area A1 which has the maximum distance difference with respect to the distance between the nozzle row N and the irradiation area A4 selected as an irradiation area for ink ejected from the nozzle row N on the outward way, as an irradiation area which is selected on the homeward way.

Since it is possible to collectively control a large number of irradiating elements, it is possible to change the intensity and timing of irradiation on each area while facilitating scanning and processing, and fine control on image quality becomes possible.

In the inkjet printing apparatus 1, the irradiation control unit 50 is configured to perform control for selecting the irradiating element E2 having a distance from the nozzle n to eject irradiation target ink which has the minimum distance difference with respect to the distance between the nozzle n and the irradiating element E1 selected as an irradiating element for ink ejected from the nozzle n on the outward way, as an irradiating element which is selected on the homeward way.

According to the above described configuration, it is possible to further reduce the time difference between the time on the outward way from when ink ejected from the nozzle n lands on the medium M to when the ink is irradiated with ultraviolet light and the time on the homeward way when ink ejected from the nozzle n lands on the medium M to when the ink is irradiated with ultraviolet light. Therefore, it is possible to further suppress variation in dot diameter.

INDUSTRIAL APPLICABILITY

The present invention can be used in inkjet printing.

The invention claimed is:

1. A printing system, comprising:

a recording medium;

a nozzle configured to eject ink to the recording medium;

a head including the nozzle;

a plurality of irradiating elements configured to irradiate the ink ejected on the recording medium with light;

irradiators including the plurality of irradiating elements;

a carriage equipped with the head and the irradiators;

a main scanning operator configured to reciprocate the carriage relative to the recording medium in a main scan direction;

an irradiation controller configured to control the plurality of irradiating elements to turn on or turn off the irradiation of light;

a program that sends instructions to the irradiation controller for controlling the irradiation controller;

wherein, in the irradiators, a first irradiator and a second irradiator are arranged on two opposing sides of the head in the main scan direction of the carriage, the first irradiator and the second irradiator are each provided with the plurality of irradiating elements in the main scan direction, wherein, the program is configured to instruct the irradiation controller in a way that:

when the carriage is reciprocated by the main scanning operator and the ink is ejected from the nozzle, as the carriage is reciprocated in a first direction along the main scan direction away from an initial position, and when a first irradiating element from the plurality of irradiating elements provided in the second irradiator is turned on for irradiating the ink ejected from the nozzle with light, the program will determine a first distance X1 between the first irradiating element and the nozzle, and when the carriage is reciprocating in a second direction along the main scan direction opposite to the first direction back to the initial position, the program will determine second distances X2 between the nozzle and the plurality of irradiating elements provided in the first irradiator, and turn on a second irradiating element from the plurality of irradiating elements provided in the first irradiator having a closest value out of the second distances X2 relative to the first distance X1, for irradiating the ink ejected from the nozzle with light, while a plurality of irradiating elements provided in the first irradiator in between the second irradiating element and the nozzle do not irradiate light when the carriage is reciprocating in the second direction.

2. The printing system according to claim 1, wherein the program is further configured to instruct the irradiation controller to turn off the plurality of irradiating elements in between the nozzle and the first irradiating element as the first irradiating element is selected to be turned on.

3. The printing system according to claim 1, wherein the irradiators comprises a plurality of irradiating units, and each of the plurality of irradiating units comprises the plurality of irradiating elements.

4. The printing system according to claim 1, wherein the ink is a curable ink that is cured by the light irradiated by the plurality of irradiating elements.

5. The printing system according to claim 1, further comprising a computer-readable recording medium for recording and reading of the program.

* * * * *